United States Patent [19]

Kircher

[11] 4,137,672

[45] Feb. 6, 1979

[54] WINDOW CONSTRUCTION

[76] Inventor: Andrew J. Kircher, 4009 Oglethorpe St., Hyattsville, Md. 20782

[21] Appl. No.: 862,111

[22] Filed: Dec. 19, 1977

[51] Int. Cl.[2] ..... E06B 3/32

[52] U.S. Cl. ..... 49/464; 49/465

[58] Field of Search ..... 49/463, 464, 465, 371; 160/91

[56] References Cited

U.S. PATENT DOCUMENTS

| | | | |
|---|---|---|---|
| 2,262,670 | 11/1941 | Ensminger | 160/91 X |
| 2,607,963 | 8/1952 | Angel | 160/91 X |
| 2,909,813 | 10/1959 | Wilson | 49/464 X |
| 2,929,446 | 3/1960 | Kuehnlein | 160/91 |

*Primary Examiner*—Kenneth Downey
*Attorney, Agent, or Firm*—Donald A. Kettlestrings

[57] ABSTRACT

A window construction is provided having a window frame with horizontal top and bottom members extending between vertical side members. The horizontal members define surfaces that slant downwardly and outwardly with respect to the frame at a predetermined angle. Window units are positioned within the frame and each unit includes a sash having horizontal elements extending between vertical side elements. The horizontal elements of each window unit define surfaces that slant downwardly and outwardly with respect to the frame at said predetermined angle. When in place, the slanting surfaces of the window units contact the slanting surfaces of the window frame to provide a weather-tight seal. Fastening means are provided to enable each window unit to be individually placed into position within and removed from the frame.

6 Claims, 4 Drawing Figures

WINDOW CONSTRUCTION

This invention relates to improvements in window construction and more particularly to a construction that can be used as an auxiliary unit for use with attached window frames or which may be permanently installed at the time of construction of the building.

Many different types of window constructions are known, but many of these constructions have proved to be relatively costly to manufacture. In addition, many of the known constructions are difficult to install, and insertion and removal of window sashes is often difficult.

It is, therefore, an object of the present invention to provide a window construction that is easy and economical to manufacture.

Another object of the invention is to provide a window construction that can be used together with existing window units to provide additional insulation for the building without requiring alteration to existing window units.

A further object of the invention is the provision of a window construction that can be included as a permanent feature of a building.

Still another object is to provide a window construction that is weather resistent but which also enables ventilation when desired.

Yet another object of the present invention is the provision of a window construction that enables persons to easily insert and remove window sashes from the interior of the building.

A still further object is to provide a window construction having interchangeable window units.

A further object is to provide a window construction which can be readily constructed in any desired size to be positioned snugly in an existing window frame.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects, the present invention provides for a window construction having a window frame with vertical side members, horizontal top and bottom members extending between the side members, and stop members projecting from outer poritons of each of the side members and located between the side members. The top member defines a lower surface which slants downwardly and outwardly with respect to the frame at a predetermined angle, and the bottom member defines a top surface which slants downwardly and outwardly with respect to the frame at the same predetermined angle.

At least one window unit is normally positioned within the frame. Each unit includes a sash having vertical side elements which contact the stop members. Horizontal upper and lower elements extend between the side elements of each window unit, and a glass pane or a screen is fitted within the sash.

The upper element of each window unit defines an upper surface slanting downwardly and outwardly with respect to the frame at said predetermined angle, and the lower element of each window unit defines a lower surface slanting downwardly and outwardly with respect to the frame at the same predetermined angle. When the window units are in place within the frame, the slanting surface of a sash upper element contacts the slanting surface of the frame top member in substantially complete contacting relationship, and the slanting surface of a sash lower element contacts the slanting surface of the frame bottom member in substantially complete contacting relationship.

Fastening means are also provided with each of the window units for cooperating with the stop members to hold the window unit in position within the frame and to enable each of the units to be individually removed from the frame.

A plurality of the window units may be positioned within each frame. In this arrangement the upper slanting surface of a lower one of the window units is in substantially complete contacting relationship with the lower slanting surface of an upper one of the window units.

It is to be understood that both the foregoing general description and the following detailed description are exemplary and explanatory, but are not restrictive of the invention.

The accompanying drawings, which are incorporated in and constitute a part of this specification, illustrate an example of a preferred embodiment of the invention and, together with the description, serve to explain the principles of the invention.

Figure 1:
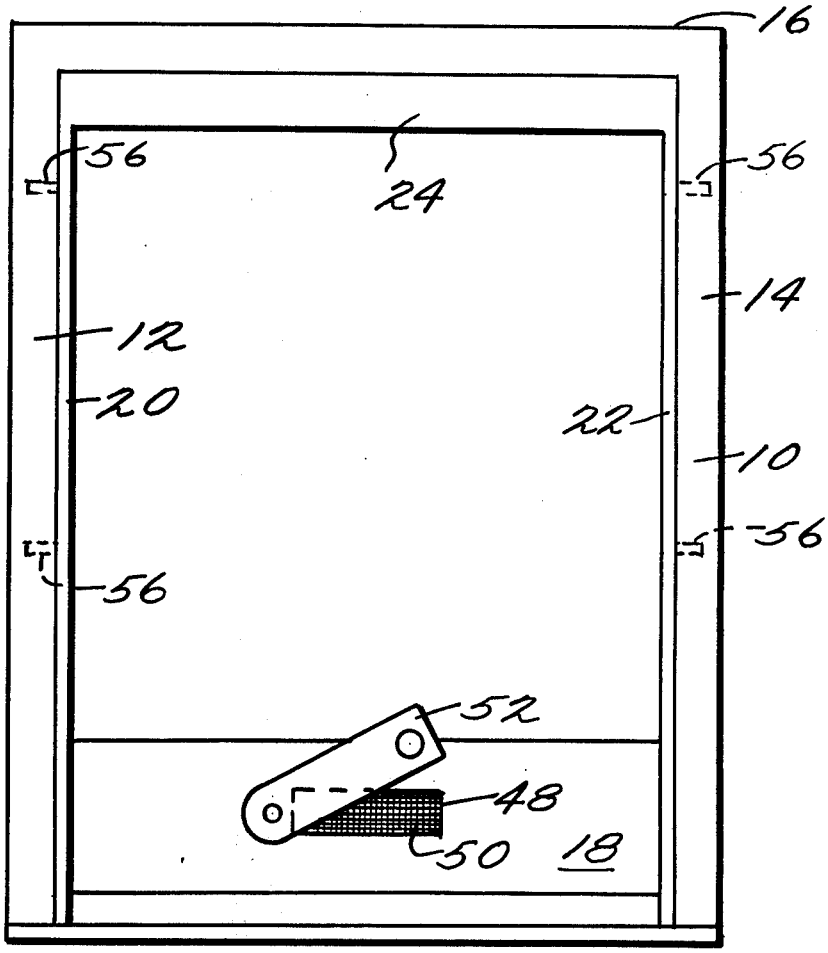
FIG. 1 is an elevation view of the frame portion of the window construction as it would be viewed from the interior of a building.
Figure 2:
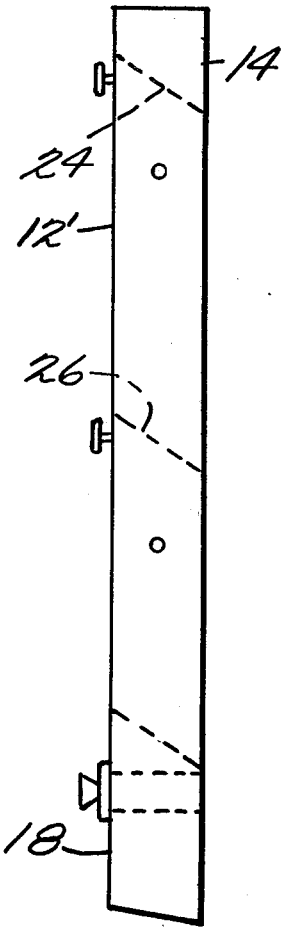
FIG. 2 is a side elevation view of the window construction with two window units in position within the frame.
Figure 3:
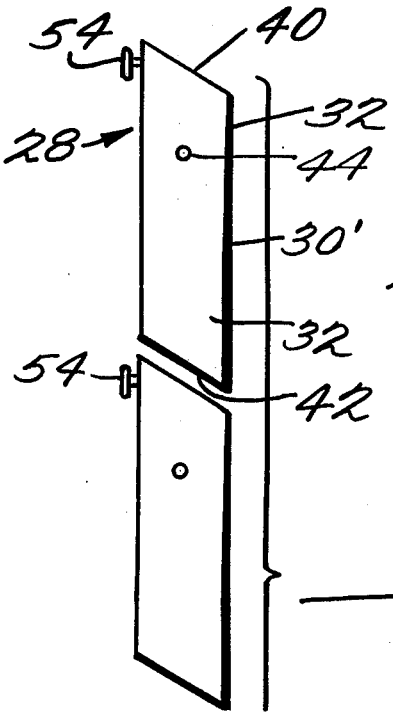
FIG. 3 is a side elevation of two window units of the window construction.
Figure 4:
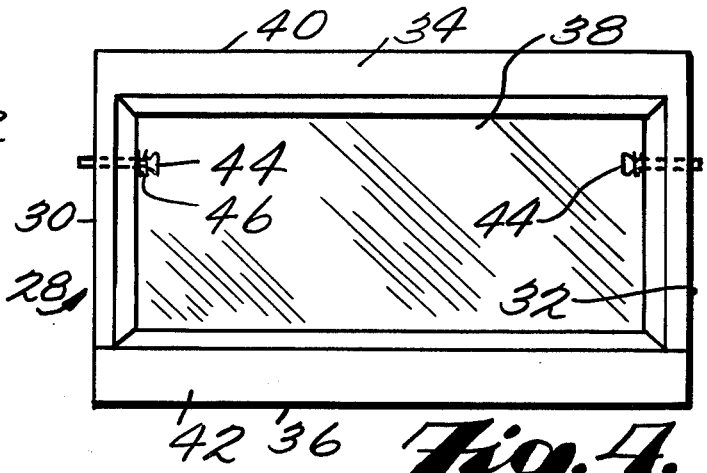
FIG. 4 is an elevation view of a window unit of the window construction.

With reference now to the drawings, wherein like reference characters designate like or corresponding parts throughout the several views, there is shown a rectangular window frame 10 having vertical side members 12, 14. A horizontal top member 16 extends between side members 12, 14, and a horizontal bottom member 18 extends between side members 12, 14. Stop members 20, 22 project from outer portions 12', 14', respectively, of each of side members 12, 14 and stop members 20, 22 are located between side members 12, 14.

Horizontal top member 16 of frame 10 defines a lower surface 24, and surface 24 slants downwardly and outwardly with respect to frame 10 at a predetermined angle. Bottom member 18 similarly defines a top surface 26, and surface 26 slants downwardly and outwardly with respect to frame 10 at the same predetermined angle as that of surface 24.

At least one window unit 28 is adapted to be selectively positioned within frame 10. One or more of window units 28 may be used within frame 10 depending upon the size of the frame. Each window unit 28 includes a sash having vertical side elements 30, 32, a horizontal upper element 34 extending between side elements 30, 32 and a horizontal lower element 36 extending between side elements 30, 32. A glass pane or screen 38 is fitted within the sash and within elements 30, 32, 34 and 36.

Upper element 34 of the sash defines an upper surface 40 which slants downwardly and outwardly with respect to frame 10 at a predetermined angle. Similarly, lower element 36 of the sash defines a lower surface 42 which slants downwardly and outwardly with respect to frame 10 at a predetermined angle. The angle of inclination of slanting surfaces 24 and 26 of frame 10 and of slanting surfaces 40, 42 of each window unit 28 is the same.

Each window unit 28 is also provided with fastening means 44. These fastening means may be spring-loaded pins or keepers 46 positioned within side elements 30, 32.

Bottom member 18 of window frame 10 preferably defines a ventilation opening 48, and a screen 50 may be placed over opening 48. Closure means 52 are also provided in operative relationship with opening 48 for enabling the opening to be selectively closed when desired. A block of material (not shown) may be cut to the size of opening 48 and can be inserted within the opening when it is desired to prevent ventilation. A hinged closure 52, as illustrated, may also be used to selectively open and close opening 48.

It may also be desirable to provide each window unit 28 with a handle 54 for enabling the window unit to be easily removed from frame 10 upon release of fastening means 44.

Installation of the window construction described herein can be easily accomplished by initially placing window frame 10 into the regular window frame or casement (not shown) of the building. Conventional fastening means (not shown) can be used for this purpose.

Because each of the window units 28 is of the same size and construction as the other window units to be used within frame 10, insertion of the window units into the frame is easily accomplished. Any one of the window units is initially positioned with lower surface 42 located below upper surface 40. Outer portions 30', 32' of vertical side elements 30, 32 are placed into contacting relationship with stop members 20, 22, respectively. The window unit is then moved vertically and in continuing contacting relationship with the stop members in an upward or downward direction. If the initial window unit inserted into frame 10 is ultimately to be positioned as the lower window unit, the unit is moved downwardly until lower surface 42 of the window unit contacts surface 26 of frame 10. Because the angle of inclination of surfaces 26 and 42 are the same, the window unit will fit snugly into position with surfaces 26 and 42 in substantially complete contacting and weatherproofing relationship. Spring-loaded pins or keepers 46 can then be inserted into receiving apertures 56 of frame 10 to hold unit 28 in position.

If a total of two window units 28 are to be used within frame 10, upper unit 28 can then be easily inserted into position. This is most readily accomplished by initially positioning the upper window unit with its lower surface 42 positioned beneath its upper surface 40. The upper window unit can then be slightly tilted with the lower most and outer portions of side elements 30, 32 placed into contacting relationship with stop members 20, 22. The upper window unit can then be lowered and simultaneously tilted outwardly with respect to frame 10 until lower surface 42 of the upper window unit contacts upper surface 40 of lower window unit 28. Because the angles of inclination of surfaces 40 and 42 of each of window units 28 and of surface 24 of frame 10 are the same, upper unit 28 will easily slide downwardly into its proper position within frame 10. Spring-loaded pins or keepers 46 of upper window unit 28 can then be inserted into receiving apertures 56 of frame 10 to maintain the upper window unit in locked position within the frame.

Surfaces 24, 26, 40 and 42 of the window construction are all slanted at the same angle. Thus, when the window units are in position within frame 10 upper surface 40 of upper unit 28 is in substantially complete and weatherproofing contact with surface 24 of the frame. Similarly, lower surface 42 of lower unit 28 is in substantially complete and weatherproofing contact with surface 26 of the frame. In addition, slanting surface 40 of lower unit 28 is in substantially complete and weatherproofing contact with slanting surface 42 of upper window unit 28. Each of the window units also contacts the inner surface of stop members 20, 22 to provide a further weatherproofing seal.

One advantage of this window construction is that window units 28 are interchangeable. In addition, the upper or lower window units can be inserted and removed in any order. For example, if upper unit 28 is inserted first then lower unit 28 can be inserted by merely sliding the lower unit downwardly and in contacting relationship with stop members 20, 22 until lower surface 42 of the window unit is in contacting relationship with stop members 20, 22 until lower surface 42 of the window unit is in contacting relationship with surface 26 of frame 10. The lower unit can then be simultaneously tilted in a forward direction with respect to frame 10 so that upper surface 40 of the lower window unit ultimately comes into contacting relationship with lower surface 42 of the upper window unit.

Removal of each of the window units from frame 10 is also easily accomplished by initially withdrawing pins or keepers 46 from receiving apertures 56. Handle 54 of the window unit to be removed is then grasped and the top of the window unit is then rotated inwardly with respect to frame 10. If the lower unit is being removed first, for example, the upper part of the unit is tilted inwardly until slanting surface 40 of the lower unit clears slanting surface 42 of the upper unit, still in place. The lower unit is then raised upwardly so that the lower portion of side elements 30, 32 of the lower unit slide upwardly along stop members 20, 22, and the lower unit is then lifted out of frame 10. Removal of the upper window unit can then be accomplished merely by removing pins or keepers 46 from receiving apertures 56 and grasping handle 54 of the upper unit. The upper window unit is then withdrawn inwardly with respect to frame 10 and removed from the frame.

This invention provides for a versatile and economical window construction. The window units are interchangeable with each other and they can be inserted into and removed from frame 10 individually. In addition, the window units can be inserted easily and quickly and they can be placed into complete weatherproofing relationship with respect to frame 10. Frame 10 does not have any guides or channels within which the window units must slide in order to be properly positioned within frame 10. The slanting surfaces of the window units and of the frame provide for drainage and also enable the units to be quickly and properly placed into position. These slanting surfaces also enable the window units to be easily rotated into and out of position within the frame and they provide for cooperation with each other in such a way as to provide weathproofing seals. Slanting surfaces 24, 26, 40, 42 may also be provided with conventional weatherproofing strips or material (not shown) to further enhance the weatherproofing seals where these surfaces abut one another.

By use of the window construction of this invention, it is not necessary for the homeowner to install and remove storm windows and screens from the exterior of the building. Rather, the window units can be easily and quickly installed and removed from within the building and all maintenance to the window can be accomplished from within the building.

The window construction may be comprised of metal, wood, or any other suitable material. In addition, one or more window units can be located within each frame depending upon the size of the frame and the size of the window units desired.

The invention in its broader aspects is not limited to the specific details shown and described, and departures may be made from such details without departing from the principles of the invention and without sacrificing its chief advantages.

What is claimed is:

1. A window construction, comprising:

a window frame having vertical side members, a horizontal top member extending between the side members, a horizontal bottom member extending between the side members and stop members projecting from outer portions of each of said side members, said stop members located between said side members;

said top member defining a lower surface, said surface slanting downwardly and outwardly with respect to said frame at a predetermined angle;

said bottom member defining a top surface, said top surface slanting downwardly and outwardly with respect to said frame at said predetermined angle;

at least one window unit positioned within said frame, said unit including a sash having vertical side elements contacting said stop members when said window unit is in position within said window frame, a horizontal upper element extending between said side elements, a horizontal lower element extending between said side elements, and a glass pane or screen fitted within said sash;

said upper element defining an upper surface slanting downwardly and outwardly with respect to said frame at said predetermined angle;

said lower element defining a lower surface slanting downwardly and outwardly with respect to said frame at said predetermined angle;

said slanting surface of said sash upper element contacting said slanting surface of said frame top member in substantially complete contacting relationship and said slanting surface of said sash lower element contacting said slanting surface of said frame bottom member in substantially complete contacting relationship; and fastening means located adjacent upper ends of said side elements and in operative relationship with each said window unit and with said frame for cooperating with said stop members, said frame and adjacent ones of said window units to hold said window unit in position within said frame.

2. A window construction as in claim 1 including a plurality of said window units positioned within said frame, the upper surface of said sash upper element of a lower one of said window units in substantially complete contacting relationship with the lower surface of said sash lower element of an upper one of said window units.

3. A window construction as in claim 2 wherein said bottom member of said frame defines a ventilation opening, and means in operative relationship with said opening for selectively closing said opening.

4. A window construction as in claim 2 further including handle means in operative relationship with each said window unit for enabling said window unit to be easily removed from said frame upon release of said fastening means.

5. A window construction as in claim 1 wherein all of said window units are substantially identical in construction to each other and wherein said window units are interchangeable with each other in use within said frame.

6. A window unit as in claim 1 wherein said fastening means include fastening elements mounted on each of said window units.

* * * * *